US009650575B2

(12) United States Patent
Mothersele

(10) Patent No.: US 9,650,575 B2
(45) Date of Patent: May 16, 2017

(54) CAVITATION HYDROCARBON REFINING

(71) Applicant: Christopher Mothersele, Calgary (CA)

(72) Inventor: Christopher Mothersele, Calgary (CA)

(73) Assignee: MechCracker Corporation, Calgary, Alberta (CA)

( * ) Notice: Subject to any disclaimer, the term of this patent is extended or adjusted under 35 U.S.C. 154(b) by 84 days.

(21) Appl. No.: 14/756,935

(22) Filed: Oct. 30, 2015

(65) Prior Publication Data

US 2016/0264877 A1 Sep. 15, 2016

Related U.S. Application Data

(60) Provisional application No. 62/177,381, filed on Mar. 13, 2015.

(51) Int. Cl.

| | |
|---|---|
| ***C10G 9/00*** | (2006.01) |
| ***C10G 50/00*** | (2006.01) |
| ***C10G 57/02*** | (2006.01) |
| ***C10G 5/06*** | (2006.01) |

(52) U.S. Cl.

CPC ..... *C10G 9/00* (2013.01); *C10G 5/06* (2013.01); *C10G 50/00* (2013.01); *C10G 57/02* (2013.01)

(58) Field of Classification Search

CPC . C10G 9/00; C10G 5/06; C10G 50/00; C10G 57/00; C10G 57/005; C10G 57/02; C10G 69/12; C10G 69/123; C07C 2/00; C07C 2/74; C07C 6/00; C07C 6/08; B01J 19/008; B01J 19/10

See application file for complete search history.

(56) References Cited

U.S. PATENT DOCUMENTS

| | | | | |
|---|---|---|---|---|
| 5,073,666 | A * | 12/1991 | Zemanian | C07C 2/76 585/400 |
| 2002/0175067 | A1* | 11/2002 | Sherwood | C07C 2/00 204/157.15 |
| 2005/0189212 | A1* | 9/2005 | Morton | B01J 19/123 204/157.15 |
| 2008/0217211 | A1* | 9/2008 | Chornet | C10G 9/007 208/106 |
| 2010/0101978 | A1* | 4/2010 | Gordon | C10G 9/007 208/49 |
| 2014/0058128 | A1* | 2/2014 | Bricker | B01J 19/10 562/30 |

OTHER PUBLICATIONS

Kaushik et al., Ultrasound cavitation technique for up-gradation of vacuum residue, Fuel Processing Technology 93 (2012), pp. 73-77.*

* cited by examiner

*Primary Examiner* — Prem C Singh

*Assistant Examiner* — Brandi M Doyle

(74) *Attorney, Agent, or Firm* — George A. Seaby

(57) ABSTRACT

Short chain hydrocarbons such as methane, ethane and propane are upgraded by liquefying the hydrocarbons, subjecting the resulting liquids to cavitation to create free alkyl radicals and hydrogen ions, and allowing the free alkyl radicals and hydrogen ions to recombine to form longer chain hydrocarbons.

6 Claims, No Drawings

CAVITATION HYDROCARBON REFINING

FIELD OF THE INVENTION

This invention relates to a process for refining hydrocarbons, and in particular to a process for upgrading short chain hydrocarbons using liquefaction and cavitation.

BACKGROUND OF THE INVENTION

Gasoline typically contains a mixture of hydrocarbon (H—C) molecules with between 4 to 12 carbon atoms per molecule, and is a liquid at ambient temperatures.

Similarly, other liquid fuels such as diesel or jet fuel are mixtures of H—C molecules with greater H—C chain lengths. Distribution of liquid hydrocarbons for consumption can be by road, rail, pipeline or ships.

The dominant constituent of natural gas is methane which contains one carbon atom per molecule and exists as a gas at ambient pressures and temperatures. Minor amounts of other H—C gases such as ethane, propane and butane constitute the remaining natural gas components.

Natural gas is normally transported to consumers in pipeline because this is the best way to connect production areas to consuming areas. However, transportation of methane from producing areas to consuming areas without pipeline connections requires a different approach.

Long-distance transportation of methane to consuming markets without pipeline connections requires liquefaction to produce liquefied natural gas (LNG) prior to shipment typically in fit-for-purpose ships. Similarly, other short-chain hydrocarbons (ethane, propane, butane) are gases at typical ambient temperatures and are moved to consumer markets by pipeline, or in a liquid state in pressurized containers when these components have been separated from each other.

Due to the abundance of natural gas it is traditionally sold at a considerable discount, on a heat basis, when compared to liquid hydrocarbons such as gasoline or diesel, and thus offers a great potential for profitable. upgrading to higher value products.

Upgrading short chain hydrocarbons to longer chain hydrocarbons such as hexane, heptane and octane results in components which can be incorporated in gasoline or diesel blends from traditional refining. Any of these upgraded hydrocarbon chains do not have the impurities associated with conventionally refined product, which typically has minor amounts of components such as sulfur, and would thus be considered to be a 'premium' product.

Liquefaction occurs when the temperature of a gas is reduced below its boiling point causing the gas to condense into a liquid. This occurs through using various refrigeration techniques including cryogenic refrigeration to achieve the low temperatures necessary to achieve liquefaction.

Liquefying short chain H—C's and subjecting the liquids to cavitation yields longer chain H—C molecules and hydrogen.

Cavitation is the creation and destruction of cavities formed in a liquid which occurs when shearing forces are applied to a liquid resulting in the formation of temporary liquid-free zones (bubbles). When the shearing forces are removed or reduced, the bubbles collapse suddenly and violently, releasing short-term 'spikes' of very high temperatures (in excess of 1000° C.) and pressures (in excess of 15,000 kPa) in the liquid.

These energy "releases" (spikes) are sufficient to alter the molecular structure of fluids and can also destroy any adjacent solid materials. The destructive forces of cavitation were first identified after ship's propellers were developed, well over 100 years ago. Since then, the problem has been extensively studied from a mitigation or avoidance perspective. The problem of cavitation also occurs in liquid pumping systems and has also been studied over the same time span.

Hydrocarbons have been subjected to cavitation processing in order to change the API gravity, reduce the viscosity or convert heavy crude oil into lighter crude oil. Examples of processes and apparatuses for cavitating hydrocarbons are described in Canadian Patent No. 2,266,670, issued to Oleg Kozyuk on Jun. 6, 2006, Canadian Patent Application No. 2,848,468, filed by Oleg Kozyuk et al on Sep. 6, 2012, U.S. Pat. Nos. 8,323,479, issued to M. Rashid Khan on Dec. 4, 2012, and 8,691,083 issued to M. Rashid Khan on Apr. 8, 2014 and U.S. Patent Applications Nos. 2003/0019791, filed by Douglas P. Austin on Jun. 17, 2003, 2006/0231462, filed by Raymond Ford Johnson on Oct. 19, 2006, 2011/0265737, filed by Robert Ryan on Aug. 4, 2009 and 2013/0062249 filed by Oleg Kozyuk et al on Sep. 6, 2012.

SUMMARY OF THE INVENTION

In accordance with the present invention, short chain hydrocarbons such as methane, ethane, propane and butane, which are gases at room temperature and pressure, are liquefied using refrigeration, and the resulting liquids are then subjected to cavitation. The cavitation process breaks C—H and/or C—C bonds in the liquid resulting in modifications to the molecular structures when the process is completed.

In this connection, it is noted that the dissociation energy of the C—H bond ranges from 339 to 444 kJ/mole and the dissociation energy of the C—C bond ranges from 250 to 348 kJ/mole. By adjusting the cavitation energy input, different bonds are targeted. In the case of methane, it is the C—H bonds which are targeted for breaking. For other gases such as ethane, propane or butane the C—C bond is the target to be broken.

DETAILED DESCRIPTION OF THE INVENTION

Specifically, the present invention provides a process for upgrading a short chain hydrocarbon gas comprising the following steps:

(a) cooling the hydrocarbon gas to produce a liquid hydrocarbon;

(b) subjecting the liquid short chain hydrocarbon to cavitation at energies sufficient to break at least one of C—H and C—C bonds; and (c) allowing the resulting hydrogen ions and free alkyl radicals to recombine to form longer chain hydrocarbons and hydrogen. The cavitation apparatus used in the process of the present invention is not part of the invention. Any cavitation apparatus can be used. Examples of cavitation apparatuses are described, for example, in the above-mentioned Canadian Patent No. 2,266,670, Canadian Patent No. 2,400,188, issued to Nikolai Ivanovich Selivanov on Feb. 19, 2008 and U.S. Pat. No. 6,019,499, issued to Nikolai I. Selivanov on Feb. 1, 2000.

By carrying out the process of the present invention using short chain hydrocarbons as starting materials, examples of the resulting changes to hydrocarbon molecular structure can be illustrated as follows:

Methane→Ethane+Hydrogen $CH_4 \rightarrow C_2H_6 + H_2$

Ethane→Butane+Hydrogen $C_2H_6 \rightarrow C_4H_{10} + H_2$

Propane→Hexane+$H_2$ $C_3H_8 \rightarrow C_6H_{14} + H_2$

Butane→Octane+Hydrogen $C_4H_{10} \rightarrow C_6H_{18} + H_2$

Pentane→Decane+Hydrogen $C_5H_{12} \rightarrow C_{10}H_{22} + H_2$

The above equations illustrate what happens when carrying out the process of the present invention using short chain hydrocarbons as starting materials. Obviously, the molecules vary significantly from the products on the right sides of the above equations, particularly if the starting liquid is subjected to cavitation repeatedly. For example, when methane is used as the sole starting material, some of the hydrogen ions will combine with each other to form hydrogen molecules, some of the free methyl radicals and hydrogen ions will recombine to form methane, and some of the methyl radicals will combine with each other to form ethane or larger H—C molecules. When more than one carbon atom is removed from the methane the resulting C—H radicals can combine to form long chain hydrocarbon molecules. The starting materials can be methane, ethane, propane and butane or mixtures thereof. Hydrocarbons having longer chains than butane are liquids at room temperature. The temperature of liquefaction must be adjusted to below the boiling point of the material to be processed.

In accordance with another embodiment of the invention, following a first liquefaction and cavitation steps, hydrogen is separated from the mixture of H—C molecules and hydrogen. The remaining hydrocarbons are liquefied and subjected to cavitation. Repeating the liquefaction and cavitation steps results in longer chain hydrocarbon molecules.

The invention claimed is:

1. A process for upgrading a short chain hydrocarbon gas comprising the steps of cooling the short chain hydrocarbon gas below its boiling point to produce a liquid short chain hydrocarbon; subjecting the liquid short chain hydrocarbon to cavitation at energies sufficient to break at least one of C—H and C—C bonds; and allowing resulting hydrogen ions and free radicals to recombine to form a mixture of longer chain hydrocarbons and gaseous hydrogen.

2. The process of claim 1, wherein the hydrocarbon gas is cryogenically cooled to below its boiling point.

3. The process of claim 1, wherein the short chain hydrocarbon gas is selected from the group consisting of methane, ethane, propane and butane.

4. The process of claim 3, wherein the liquid short chain hydrocarbon is subjected to cavitation at energies from 250 to 384 kJ/mole of gas to break C—C bonds.

5. The process of claim 3, wherein the liquid short chain hydrocarbon is methane, and the liquid methane is subjected to cavitation at energies in the range of 339 to 444 kJ/mole to break C—H bonds.

6. The process of claim 3 further comprising the steps of separating hydrogen from the mixture of longer chain hydrocarbons and gaseous hydrogen; cooling the longer chain hydrocarbons to produce liquid longer chain hydrocarbons; subjecting the liquid longer chain hydrocarbons to cavitation; and allowing resulting hydrogen and free hydrocarbon radicals to recombine to form a mixture of even longer chain hydrocarbon and gaseous hydrogen.

* * * * *